US006620116B2

(12) United States Patent
Lewis

(10) Patent No.: US 6,620,116 B2
(45) Date of Patent: Sep. 16, 2003

(54) EXTERNAL COUNTERPULSATION UNIT

(76) Inventor: Michael P. Lewis, 4295 San Felipe, Suite 250, Houston, TX (US) 77027-2915

( * ) Notice: Subject to any disclaimer, the term of this patent is extended or adjusted under 35 U.S.C. 154(b) by 99 days.

(21) Appl. No.: 09/733,276

(22) Filed: Dec. 8, 2000

(65) Prior Publication Data

US 2002/0173735 A1 Nov. 21, 2002

(51) Int. Cl.[7] ..... A61H 31/00
(52) U.S. Cl. ..... 601/41; 601/44; 601/152
(58) Field of Search ..... 601/152, 41, 44, 601/151; 602/13; 128/DIG. 20

(56) References Cited

U.S. PATENT DOCUMENTS

| | | | | |
|---|---|---|---|---|
| 891,181 A | * | 6/1908 | Mitchell | 128/DIG. 20 |
| 3,654,919 A | | 4/1972 | Birdwell | |
| 3,734,087 A | | 5/1973 | Sauer et al. | |
| 3,783,859 A | | 1/1974 | Sauer et al. | |
| 3,786,802 A | | 1/1974 | Hagopian et al. | |
| 3,835,845 A | | 9/1974 | Maher | |
| 3,862,629 A | | 1/1975 | Rotta | |
| 3,866,604 A | | 2/1975 | Curless et al. | |
| 3,878,839 A | | 4/1975 | Norton et al. | |
| 4,077,402 A | | 3/1978 | Benjamin, Jr. et al. | |
| 4,253,449 A | | 3/1981 | Arkans et al. | |
| 4,738,249 A | | 4/1988 | Linman et al. | |
| 4,753,226 A | | 6/1988 | Zheng et al. | |
| 5,000,164 A | | 3/1991 | Cooper | |
| 5,090,417 A | | 2/1992 | Mollan et al. | |
| 5,174,281 A | * | 12/1992 | Lee | 601/152 |
| 5,407,418 A | | 4/1995 | Szpur | |
| 5,554,103 A | | 9/1996 | Zheng et al. | |
| 5,769,800 A | * | 6/1998 | Gelfand et al. | 601/151 |
| 5,997,540 A | | 12/1999 | Zheng et al. | |
| 6,010,471 A | * | 1/2000 | Ben-Noon | 601/149 |
| 6,076,013 A | | 6/2000 | Brennan et al. | |
| 6,078,235 A | | 6/2000 | Schebitz et al. | |

OTHER PUBLICATIONS

Lueptow, et al Circulatory model studies of external cardiac assist by counterpulsation, Cardiovascular Research, 1981, 15, 443–455.

* cited by examiner

*Primary Examiner*—Danton D. DeMille
(74) *Attorney, Agent, or Firm*—Kenneth A Keeling; James E. Hudson III

(57) ABSTRACT

This invention is an improved medical device for non-invasive counterpulsation treatment of heart disease and circulatory disorder through external cardiac assistance. The device is comprised of cuffs which are affixed on a patient's lower body and extremities, and which constrict by electromechanical activation, thereby augmenting blood pressure for treatment purposes. Cuffs contain preferably fixed volume fluids such as gel, air, or water. Cuffs wrap around and are affixed to the patient's lower body and limbs. Computer or electronic means automatically correlate constriction of electromechanical actuators in the cuffs variably with the patient's measured physiological indicators, including diastolic and systolic heart functions, thereby augmenting blood pressure and optimizing benefit of counterpulsation treatment.

37 Claims, 11 Drawing Sheets

EXTERNAL COUNTERPULSATION UNIT

BACKGROUND OF THE INVENTION & RELATED ART

There are a variety of medical conditions in which the heart cannot pump enough blood to meet the body's normal requirements for nutrients and oxygen. Congestive heart failure is one condition in which the heart cannot pump enough blood to meet the needs of the body's other organs. Cardiac output can be too low for a variety of reasons, including coronary artery disease, endocarditis and myocarditis, diabetes, obesity, past heart attacks, high blood pressure, congenital defects, valve disease, or thyroid disease, to name a few. Where cardiac output slows, blood returning to the heart through veins can back up, causing fluid build up in the tissues. When cardiac output is too low, the body may take compensatory action including retention of salt by the kidneys. In response to salt retention, the body may retain greater quantities of water to balance sodium, and excess fluids can escape from the circulatory system causing edema (swelling) in other parts of the body. Edema is one of many complications arising from reduced cardiac output and congestive heart failure. The present invention is useful in treating edema, congestive heart failure and reduced cardiac output. Coronary artery disease is another condition that results in insufficient quantities of blood being pumped. Angina pectoris is a condition resulting from coronary artery disease. The present invention is useful in treating both coronary artery disease and angina pectoris.

There have been various devices in the prior art to treat patients through the use of non-invasive units and counterpulsation, but they are limited in their mechanical operation, precision of operation, and have failed to address concerns of the present invention.

External counterpulsation developed as a means of treating reduced cardiac output and circulatory disorder stemming from disease. Counterpulsation treatments involve the application of pressure, usually from distal to proximal portions of a patient's extremities, where such application is synchronized with heart rhythms. The treatment augments blood pressure, typically increasing pressure during the diastolic phase of the heart, as such treatment is known to relieve and treat medical conditions associated with reduced cardiac output. Clarence Dennis described an early hydraulic external counterpulsation device and method of its use in U.S. Pat. No. 3,303,841 (Feb. 14, 1967). Dr. Cohen, in American Cardiovascular Journal (30(10) 656–661, 1973) described another device for counterpulsation that made use of balloons which would sequentially inflate and deflate around the limbs of a patient to augment blood pressure. Similar devices using balloons have been described in Chinese patents CN 85200905 (U.S. Pat. No. 4,753,226); Chinese patents CN 88203328, and CN 1057189A.

A series of Zheng patents, including U.S. Pat. No. 4,753,226 (Jun. 28, 1988), U.S. Pat. No. 5,554,103 (Sep. 10, 1996), and U.S. Pat. No. 5,997,540 (Dec. 7, 1999) disclose counterpulsation devices employing sequential inflation of balloon cuffs around the extremities, wherein cuffs are inflated by fluid. All three Zheng patents disclose an external counterpulsation device where a series of air bladders are positioned within a rigid or semi-rigid cuff around the legs. The bladders are sequentially inflated and deflated with fluid, such that blood pressure is augmented in the patient. The Zheng '103 and Zheng '540 patents provide for cooled fluid and for monitoring of blood pressure and blood oxygen saturation; however, both retain a similar mechanism dependent on compression of fluid such as air or water. The Zheng '540 modifies the shape of the air bladder and cuffs, but retains a similar mechanism requiring rapid fluid distribution, influx and efflux through balloons in the cuffs.

Deficiencies with the prior counterpulsation technologies include the requirement of a relatively heavy and noisy air compressor and fluid reservoirs for inflating and deflating the cuffs; a lack of portability due to the size and weight of the apparatus; and the need for more than a 120 volt current. There are deficiencies with regard to patients being bounced up and down while subjected to the treatment. Additionally, because the prior art requires circuitous movement of fluid through the apparatus, there is a consequent lack of ability to manipulate action of the cuffs with a high degree of precision.

BRIEF SUMMARY OF THE INVENTION

It is therefore the object of the present invention to provide a counterpulsation apparatus for treatment of patients utilizing actuator cuffs that compress by electromechanical, rather than by pneumatic means, and which can be precisely controlled by the operator.

The present invention provides the ability to select which actuator cuffs and individual actuators on each cuff are included in the treatment. For example, treatment of an amputee would not require all possible individual actuators or actuator cuffs and the present invention permits eliminating unnecessary cuffs or individual actuators from the treatment. This improvement is in contrast to prior art which does not allow the operator to disengage a single cuff on a particular region of the unit while other cuffs continue to operate.

The present invention further allows the operator to select the sequence of actuation of each actuator on each cuff when they are affixed to a patient. This improvement is in contrast to prior art requiring sequence from distal to proximal.

The present invention allows the operator to vary the pressure (constriction) applied by each actuator cuff and each actuator on each cuff with a high degree of precision. This improvement is in contrast to prior art which uses the same pressure in each cuff.

The present invention allows the operator to vary the time difference (delay) between constriction of one actuator or actuator cuff and constriction of another. This improvement is in contrast to prior art not permitting such control.

The present invention allows the operator to vary the duration and strength of compression and relaxation of each actuator cuff and each actuator on each cuff.

The present invention provides a more comfortable treatment for patients as they are not bounced up and down by inflation and deflation, and because the noise level of the apparatus is significantly reduced by use of electromechanical cuff actuators.

In the preferred embodiment, the present invention provides a more accessible treatment due to its portability, significantly reduced weight, and ability to run on a 120 volt current.

The present invention has control parameters set in software used with a computer that controls activation of each of the actuators and actuator cuffs; such parameters are variable with needs of individual patient's treatment.

It is the object of the present invention to correlate compression of each of the cuff actuators with a patient's physiological indicators (including EKG heart rhythms, blood pressure, cardiac output, and respiration) to augment blood pressure during diastole, thereby achieving optimal benefit from counterpulsation technology in the treatment of congestive heart failure, reduced cardiac output, coronary artery disease, and related diseases and symptoms. This invention provides a novel mechanism for achieving counterpulsation treatment, namely electromechanical actuator cuffs that dispense with the need for pneumatic devices made to rapidly inflate and deflate the cuffs.

DETAILED DESCRIPTION OF THE INVENTION

This invention is a medical device for non-invasive treatment of reduced cardiac output, congestive heart failure, angina pectoris, heart disease and related circulatory disorders through external counterpulsation. Counterpulsation has traditionally involved the application of sequential pressures on the lower legs, upper legs and buttocks through pneumatic cuffs placed on those regions. Application of pressure to the extremities has been timed to correlate with a patient's physiological rhythms, such as diastolic and systolic phases of the heart. This application of force by the cuffs pushes blood upward toward the heart, whereby blood pressure is increased during the diastolic phase of the heart. This enhanced pressure is recognized as medically beneficial for treatment of medical conditions relating to blood circulation. The present invention, however, does not make use of pneumatic or inflatable devices for application of pressure. Rather, the present invention utilizes electromechanically controlled cuffs that compress on activation and apply pressure to a patient's body. Rather than pneumatic or inflatable devices, the present invention uses constriction means attached to cuffs; the cuffs are typically filled with fluid, air, gel, or foam material. Cuffs are primarily flat structures designed to wrap around extremities such as the legs, arms, or midsections of a body. When wrapped around the extremity, the ends of the cuffs are attached securely to one another, in a manner such that electrical activation of actuators on each of the cuffs will cause them to further constrict, thereby applying pressure to the extremity or portion of the body to which they are affixed. Electromechanical means for constriction of cuffs are preferably solenoid actuators (linear or rotary) at one end of the cuff connected to a mount at the opposite end of the cuff preferably by either straps or rods. This pressure from the cuff forces blood from the extremity toward the patient's heart during diastole. Typically, cuffs will release immediately prior to the systolic phase of the patient's heart. It is this augmentation of blood pressure during diastole that provides curative benefit from counterpulsation treatment.

Figure 1:
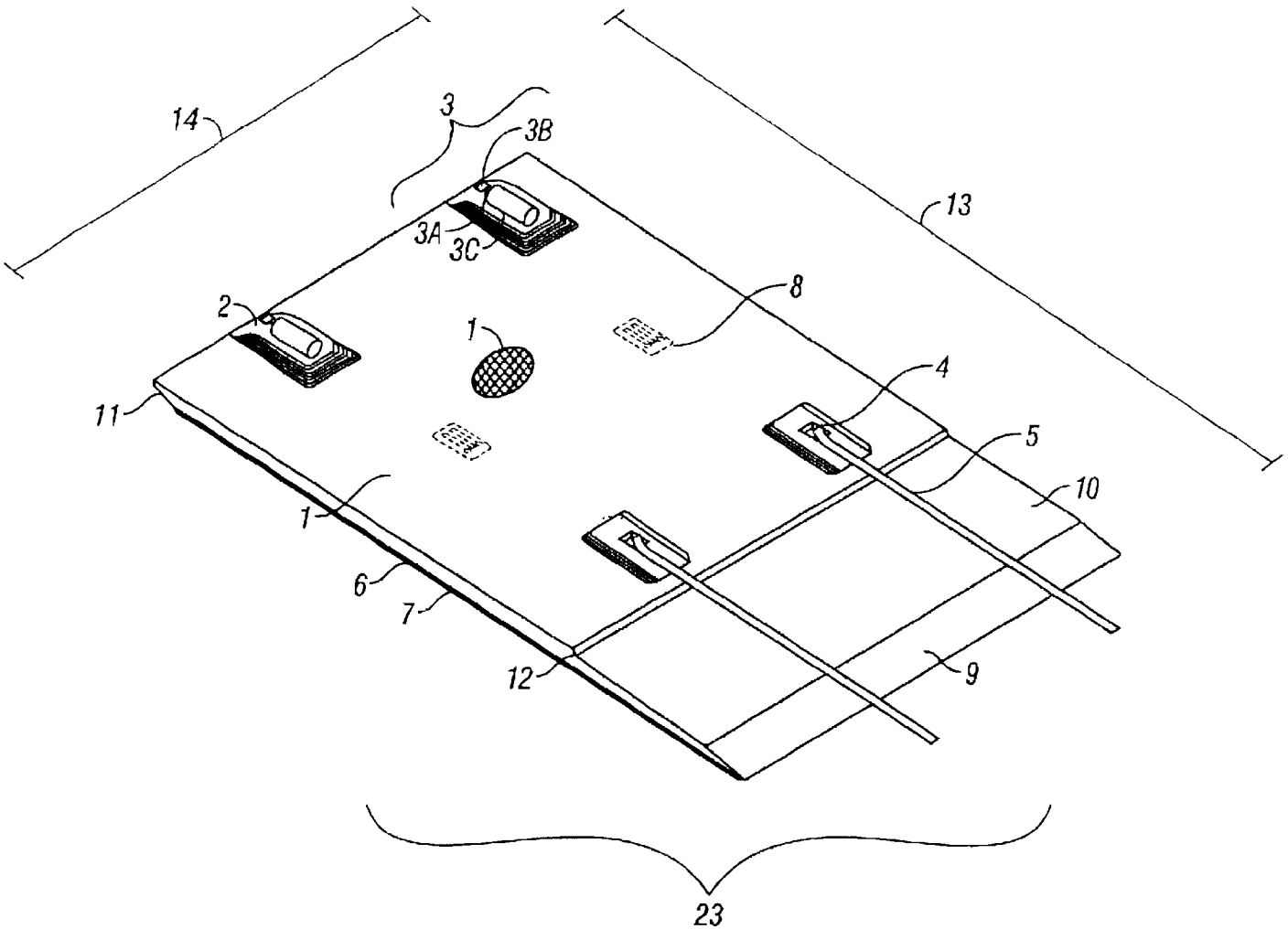
FIG. 1 is an isometric view of an unfastened electromechanical actuator cuff used in counterpulsation treatment and designed for affixation to a patient's extremities.

FIG. 1 represents a single section electromechanical actuator cuff 23 used with the present invention and for use with counterpulsation treatment. The counterpulsation treatment involves augmenting blood pressure by activating a plurality of electromechanical actuators on cuffs which are affixed to a patient at one or more positions on the body and which compress, sequentially or in other controlled manner, to correlate with physiological data including, but not limited to EKG, plethysmograph, cardiac output, heart rate, blood pressure, heart stroke volume, blood oxygen levels, systole and diastole. A variety of devices in the medical industry are used to detect and electrically transmit this physiological data from a patient. After such data is collected, it is typically processed within counterpulsation treatment parameters to determine proper sequence of cuff activation. Such data is received and processed, typically with a computer and software designed for counterpulsation treatment. Data may also be processed with dedicated electronic components. Typically, a computer or dedicated electronic component processes the patient's electronic physiological data as well as electronic feedback data derived from pressure sensors 8 built into the cuffs. These pressure sensors 8 detect pressure applied to the patient and transmit data on material strain affecting the cuff during operation.

Cuffs are actuated according to treatment parameters and correlate with the patient's physiological data, such as diastolic and systolic phases of the heart, to augment blood pressure as necessary. The compression strength, compression duration, and delay between activations can be varied separately for each cuff and individual actuator used in treatment. The compression strength, compression duration, and delay between activations can be varied separately for each individual actuator on each cuff. The actuators on the cuffs can constrict in many combinations of sequence, pressure, and duration. Three preferable manners are: first, where pressure is graded, second where pressure is applied sequentially, and third where graded pressure is applied sequentially. Compression strength, compression duration, and delay between actions can also be varied upon relaxation of cuffs and individual actuators. The actuators on the cuffs relax in three preferable manners: first where pressure is graded, second where pressure is relaxed sequentially, and third where graded pressure is relaxed sequentially. Pressure on a patient can also be released by all actuators simultaneously.

Graded pressure means that each cuff, or each actuator on each cuff, is set to constrict at a different strength. For example, cuffs or actuators at a patient's calves may be set to compress at a greater strength than cuffs or actuators affixed to a patient's thighs. In this manner, even where all actuators constrict simultaneously, pressure will vary at separate locations on the patient. Actuators are preferably adjusted so that pressure will increase or decrease from distal to proximal direction on a patient or vice versa. Each actuator and each cuff may also release pressure at variable sequences and at varying strengths. Pressure on a patient can be released one actuator at a time, in any sequence, and at any pressure within treatment parameters.

Actuator cuffs and individual actuators can apply sequential pressure to a patient. Cuffs and actuators preferably constrict in sequence, from a distal to proximal direction or vice versa. Each cuff and each actuator in the counterpulsation unit also preferably relaxes in sequence. Individual cuffs or actuators may be removed from a sequence of activations, or can be set independently of one another so that one cuff or one actuator in a series constricts more frequently per period of time than will a separate cuff or individual actuator. All cuffs and individual actuators will preferably operate in sequence, whether or not there are gradations in pressure from actuator to actuator or from cuff to cuff.

Graded sequential pressure involves variations in constriction force (pressure) from actuator to actuator or from cuff to cuff and where actuators or cuffs will operate in sequence. For example, actuators at a patient's ankles may be set to constrict with greater force (applying greater pressure) than actuators fixed to cuffs on a patient's hips. In addition to graded pressure, the actuators are set to activate in sequence starting from the patient's feet and moving upward to the actuator on the patient's hip. In this same example, actuators would relax in like sequence, thereby creating a precisely controlled peristaltic motion by the cuffs on the patient.

Cuffs constrict preferably in sequence on a patient from a distal to proximal direction with increments in the range of 35.0 to 50.0 milliseconds between initial activation of separate sequential cuffs. Cuffs preferably relax in sequence on a patient from a distal to proximal direction with like increments in the range of 35.00 to 50.00 milliseconds between initiation of relaxation of separate sequential cuffs. All actuators on each of the cuffs preferably operate within a compression strength range of 0.1 and 7.0 pounds of pressure per square inch for each actuator. Cuffs are also able to compress or relax in the opposite direction, from proximal to distal direction on the patient and in the same time increments, typically in the range of 35.0 to 50.0 milliseconds between initiation of activation of compression or initiation of relaxation of sequential cuffs.

Figure 8:
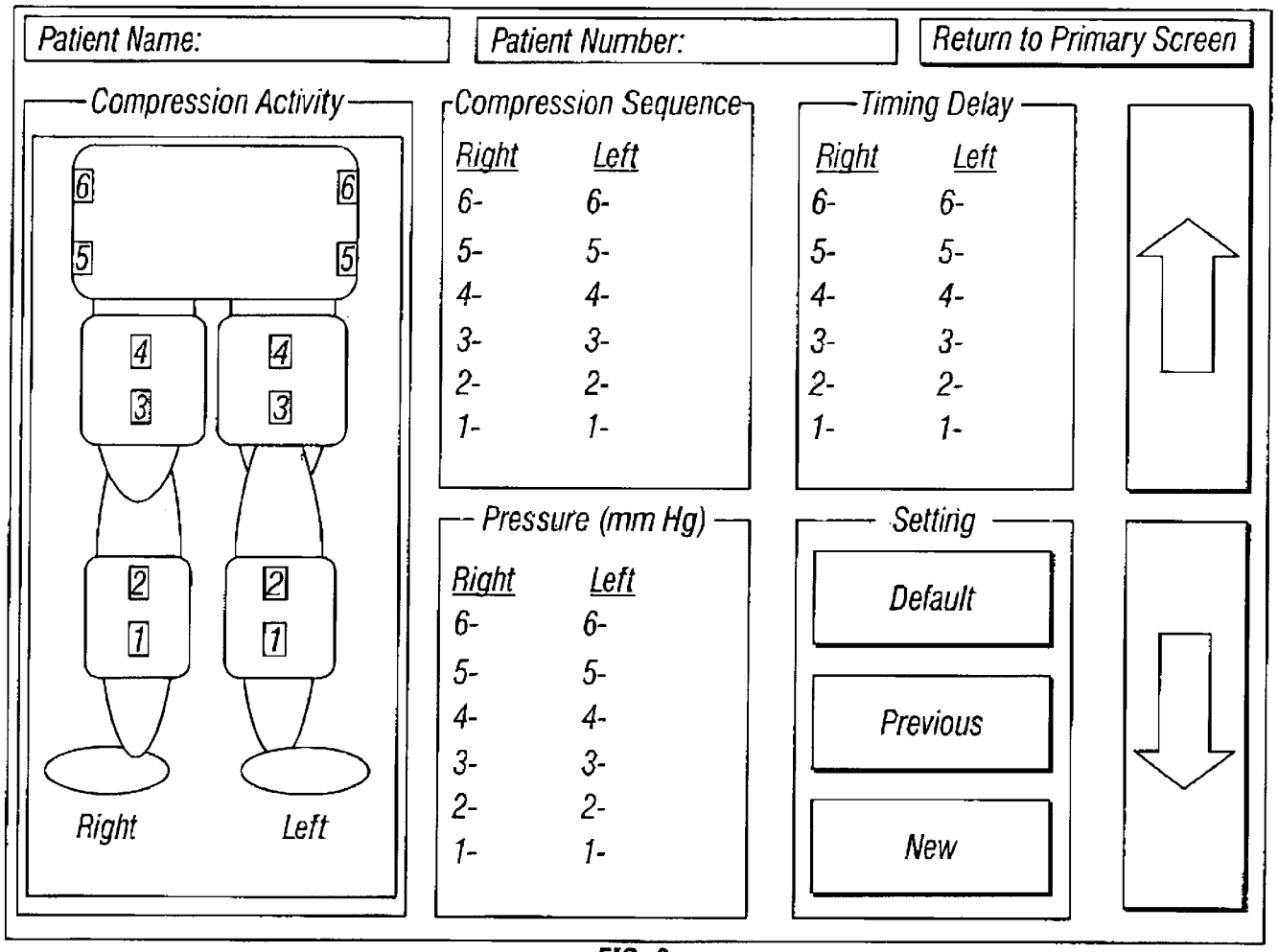
FIGS. 8 and 9 depict typical computer display screens used for monitoring and adjusting operation of cuffs on this counterpulsation unit.

The counterpulsation unit which is this invention has individual actuators on each cuff, each of which is separately controlled. FIG. 8 is used for purposes of describing one preferable range of operation for sequential activation of individual actuators. FIG. 8 depicts cuffs placed on a patient, each cuff having a preferable number of individual actuators. A plurality of actuators are preferably on each cuff, including two separate actuators per cuff as depicted in FIG. 8. A typical delay between initiation of activation of any two sequential (adjacent) actuators is in the range of 12 to 36 milliseconds. Using FIG. 8, a typical delay between initiation of activation of compression of the first and second actuators is in the range of 24 to 36 milliseconds. A typical delay between initiation of activation of compression of the second and third actuators is in the range of 12 to 18 milliseconds. A typical delay between initiation of activation of compression of the third and fourth actuators is in the range of 24 to 36 milliseconds. A typical delay between initiation of activation of compression of the fourth and fifth actuators is in the range of 12 to 18 milliseconds. A typical delay between initiation of activation of compression of the fifth and sixth actuators is in the range of 24 to 36 milliseconds. Notwithstanding typical delays between actuators, an attending physician is able to adjust timing of delay between initiation of each actuator as he or she sees fit during treatment of the patient.

Figure 9:
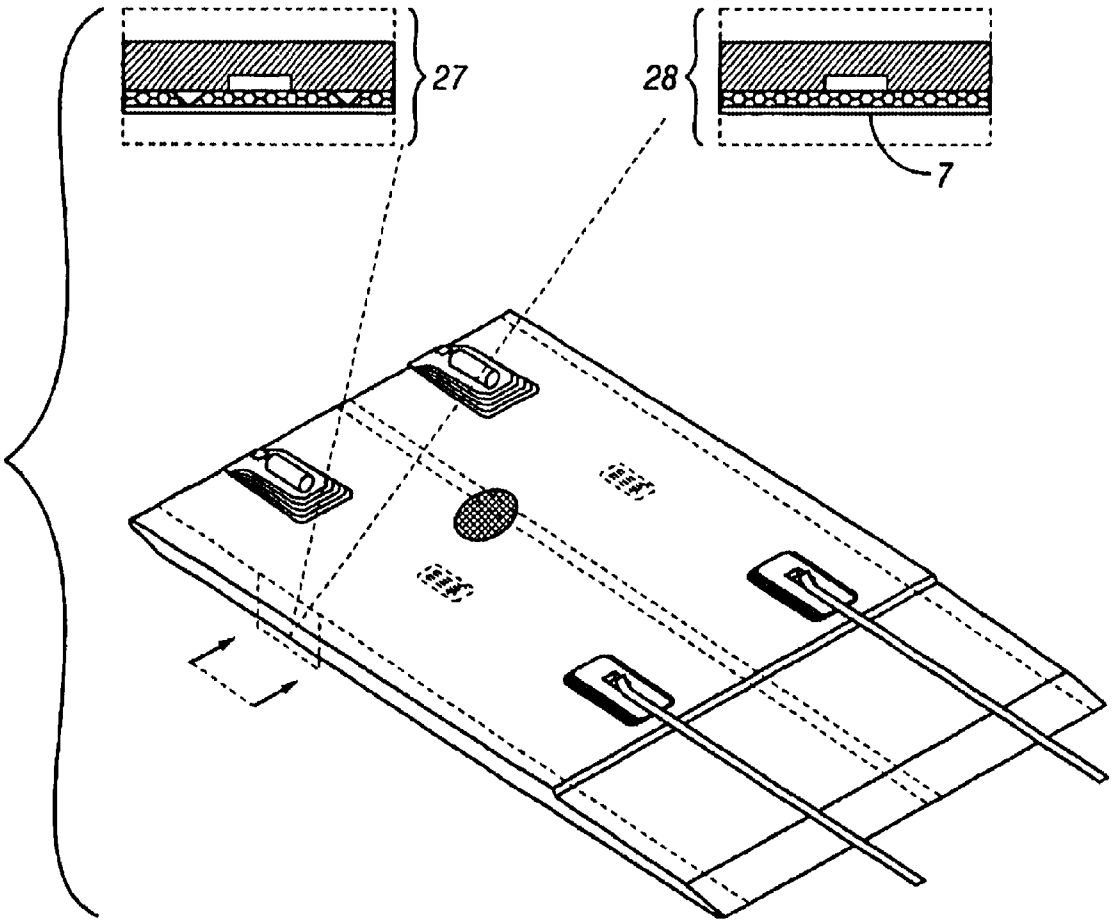

Preferably, interactive touch screen video monitors display tracking of all physiological indicators, such as systole, diastole, blood pressure, oxygen saturation of the blood, ECG, stroke volume, diastolic to systolic ratios, cardiac output, and heart rate. Monitors are typically housed in a console and such touch screen monitors are preferable means through which an attending physician or nurse may input data affecting cuff operation and obtain printouts of monitored data. FIGS. 8 and 9 depict preferable interactive screens whereby such data is monitored and actuator and cuff operation are controlled. The attending physician or nurse can input data through the touch screen or keyboard, and control all features of cuff operation, including but not limited to frequency of activation and compressions per cuff and cuff actuator, strength of constriction per actuator or cuff, duration of constriction and release for each cuff and cuff actuator, whether a particular cuff is used at all in treatment, sequence and direction of cuff operation, and delay between activation or release of each cuff or individual cuff actuator. Monitors also typically track activation status of each of the cuffs on the patient, showing for each cuff, data including but not limited to compressions, sequence with other cuffs, and strength of each compression for each cuff. The attending physician or nurse is able to maintain optimal benefit of counterpulsation treatment due to the ability to adjust activation of each cuff and each actuator during treatment. This is important as it is known that any patient's responsiveness or tolerance to treatment can change in a relatively short period of time during treatment.

FIG. 1 pictures an electromechanical actuator cuff designed for affixation to a patient's extremities (arms, legs). The preferable rectangular shape of the cuff can be varied by manufacture or adjustment to accommodate different body shapes and sizes. For instance, the actuator cuff depicted in FIG. 1 may be adapted in size to fit a calf, thigh, forearm, upper arm, or wrist of an infant, child, or adult patient. Additionally, each cuff in the present counterpulsation unit is preferably adapted in a more conical or trapezoidal shape to accommodate increasing or decreasing thicknesses of patient extremities. Trapezoidal shaping improves the cuffs ability to encompass a patient's extremity and receive optimal benefit of actuator constriction.

Figure 7:
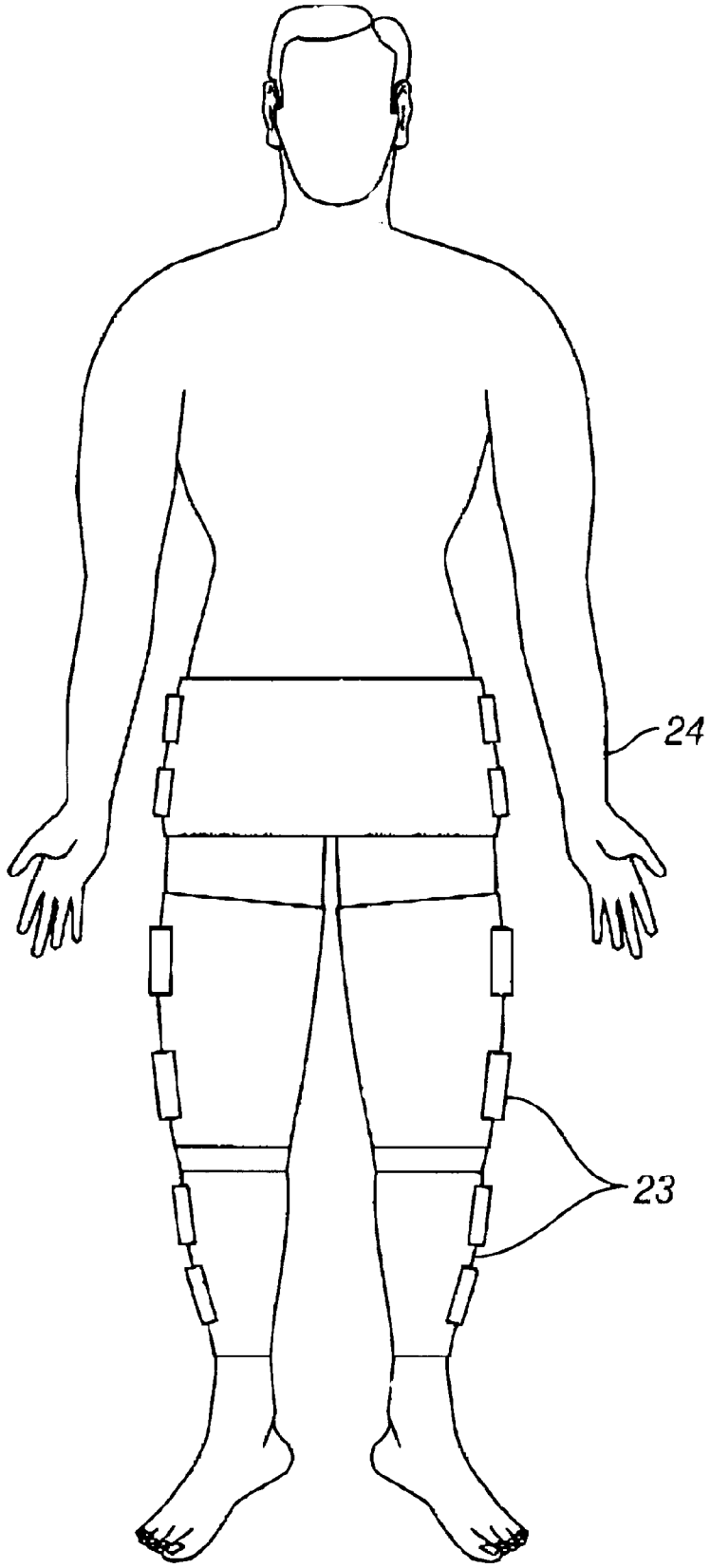
FIG. 7 depicts how cuff embodiments of the present counterpulsation unit are typically affixed to a patient.

FIG. 7 depicts how the present invention preferably operates through the use of numerous cuffs attached to the patient at the same time. There are two embodiments of the actuator cuff, a double section embodiment of the actuator cuff 24 and a single section cuff 23 which are both shown in FIG. 7 as they would typically appear when affixed to a patient. The double section embodiment 24 is affixed to the patient's buttocks and hips, whereas the single section cuffs 23 are preferably affixed to the patient's thighs and calves. Both cuff embodiments are preferably affixed to a patient at the same time. However, while all cuffs can be operated simultaneously, each cuff and each of the actuators on each cuff can be operated separately with different or identical compression sequences, strengths, and delays between individual actuator cuffs or between individual actuator activation or relaxation. For instance, with the present invention, it would be possible to cause a cuff affixed to a patient's ankle to constrict more frequently in a set period of time than a cuff situated on the same leg, but on the thigh. Additionally, the cuff of the present invention is able to apply pressure to an extremity almost instantaneously from the time the activation signal is sent due to its electromechanical rather than pneumatic operation. Pressure can additionally be relaxed with a high degree of precision with the present invention. Counterpulsation typically relies on reduction of pressure on the patient's extremities during the systolic phase of the heart. Instead of instant deflation of all cuffs at systole, the present invention, which does not require deflation, can vary the time frames during systole and the degree of pressure reduced on each cuff. The present invention, which does not rely on inflation or deflation, can more aptly gradually reduce pressure with each cuff and each individual cuff actuator.

Figure 2A:
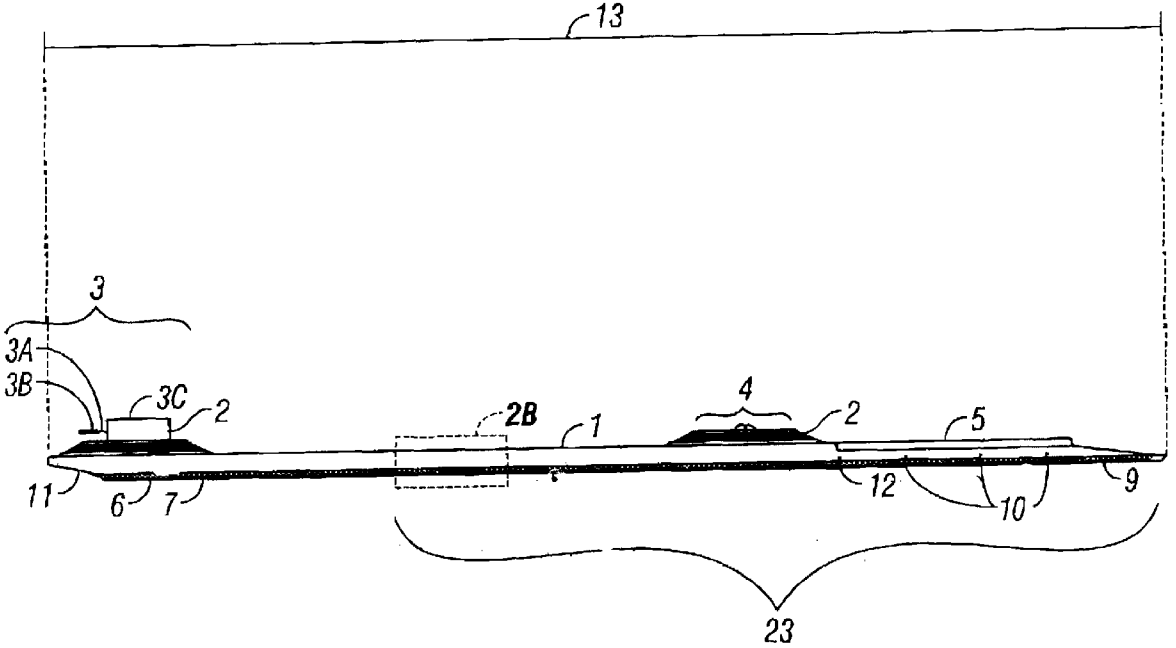
FIG. 2 is an end view of the electromechanical actuator cuff depicted in FIG. 1 and additionally has a sectional view of cuff construction at the top of the page.
Figure 2B:
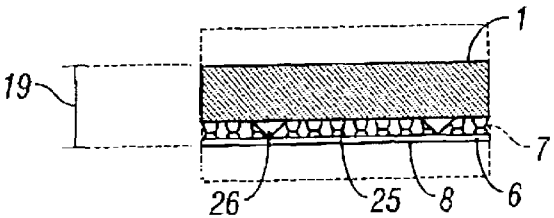

The dimensions of one embodiment of the electromechanical actuator cuff as depicted in FIG. 1 are as follows. The width 14 of the cuff depicted in FIG. 1 is in the range of 1.0 and 20.0 inches; the length 13 is in the range of 4.0 and 40.0 inches. The actuator cuff thickness 19 as shown in FIG. 2, means the sum measurement of a typical cuff construction, including flexible surface layer 1, flexible bladder section 7, and flexible liner layer 6 at its thickest point in the cuff in the range of 0.1 and 3.0 inches. The actuator cuff can be made of one material throughout its thickness, but typically has more than one layer, including a flexible surface layer 1 that is made of a material for flexibility, appearance, durability, and strength. This flexible surface layer 1 is typically of kevlar, plastic, nylon, or aramid. The flexible surface layer 1, is preferably made from a resilient construction which will not have significant stretch within the range and duration of the unit's operation.

Contiguous with the bottom of flexible surface layer 1 is typically a flexible bladder section 7, which contains a fixed volume of fluid substance. Flexible bladder section 7 preferably contains fluid such as air, gel, foam substance, beads (typically plastic), or water. Bladder section 7 is flexible so that it bends with the actuator cuff on compression. The bladder section 7 may be filled with air prior to use of the cuff, however, it does not inflate or deflate pneumatically upon activation of the cuff. Bladder section 7 is preferably comprised of a plurality of bladder subsections 25 (shown in FIG. 2), which run along the width of a cuff, and with empty cavities 26 between each subsection 25. These bladder subsections 25 and empty cavities 26 further enhance flexibility of the bladder section 7 and cuff as it constricts during operation.

Figure 3:
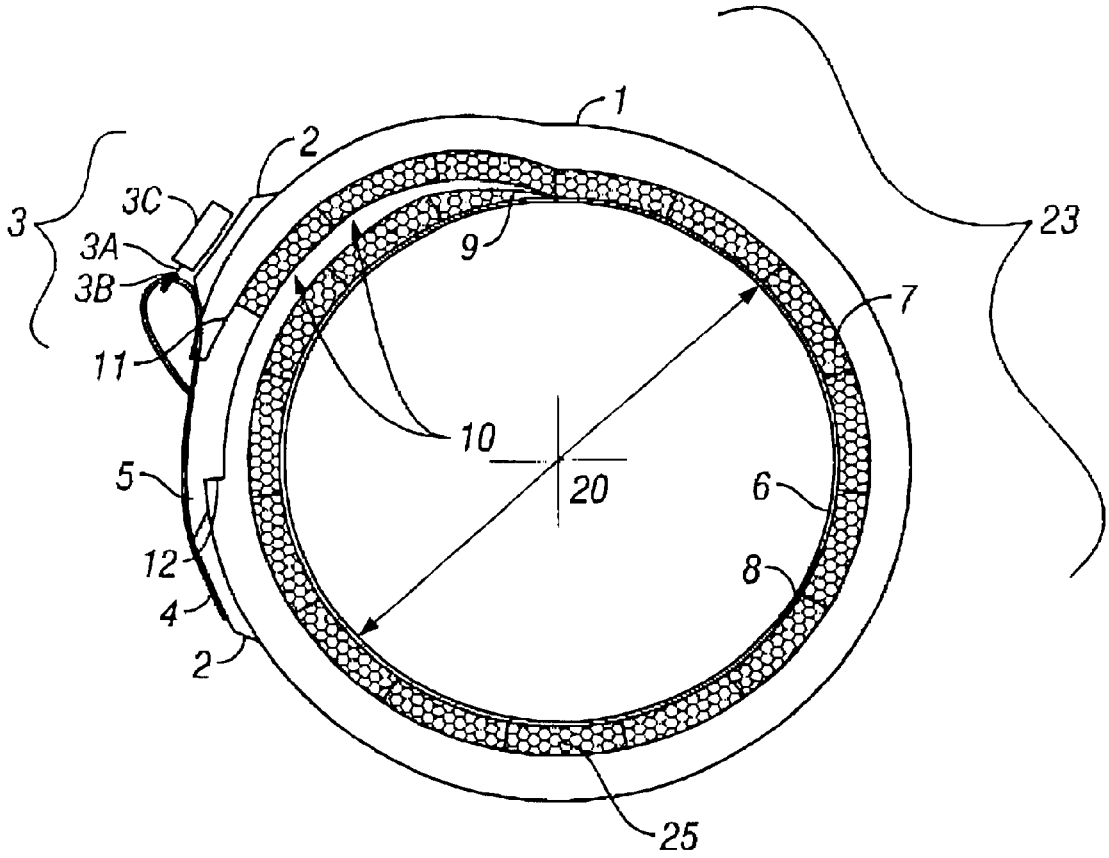
FIG. 3 is an end view of the electromechanical actuator cuff in FIGS. 1 and 2 as the cuff would appear fastened during use.

FIG. 3 is an end view of the electromechanical actuator cuff depicted in FIG. 1. It provides a more detailed picture and sectional view of the flexible surface layer 1 as it is preferably positioned in one embodiment relative to the flexible bladder section 7, flexible liner layer 6, and pressure sensor 8. Additionally, FIG. 3 provides a detailed view of bladder subsections 25 and empty cavities 26 that preferably comprise the flexible bladder section 7.

Figure 10:
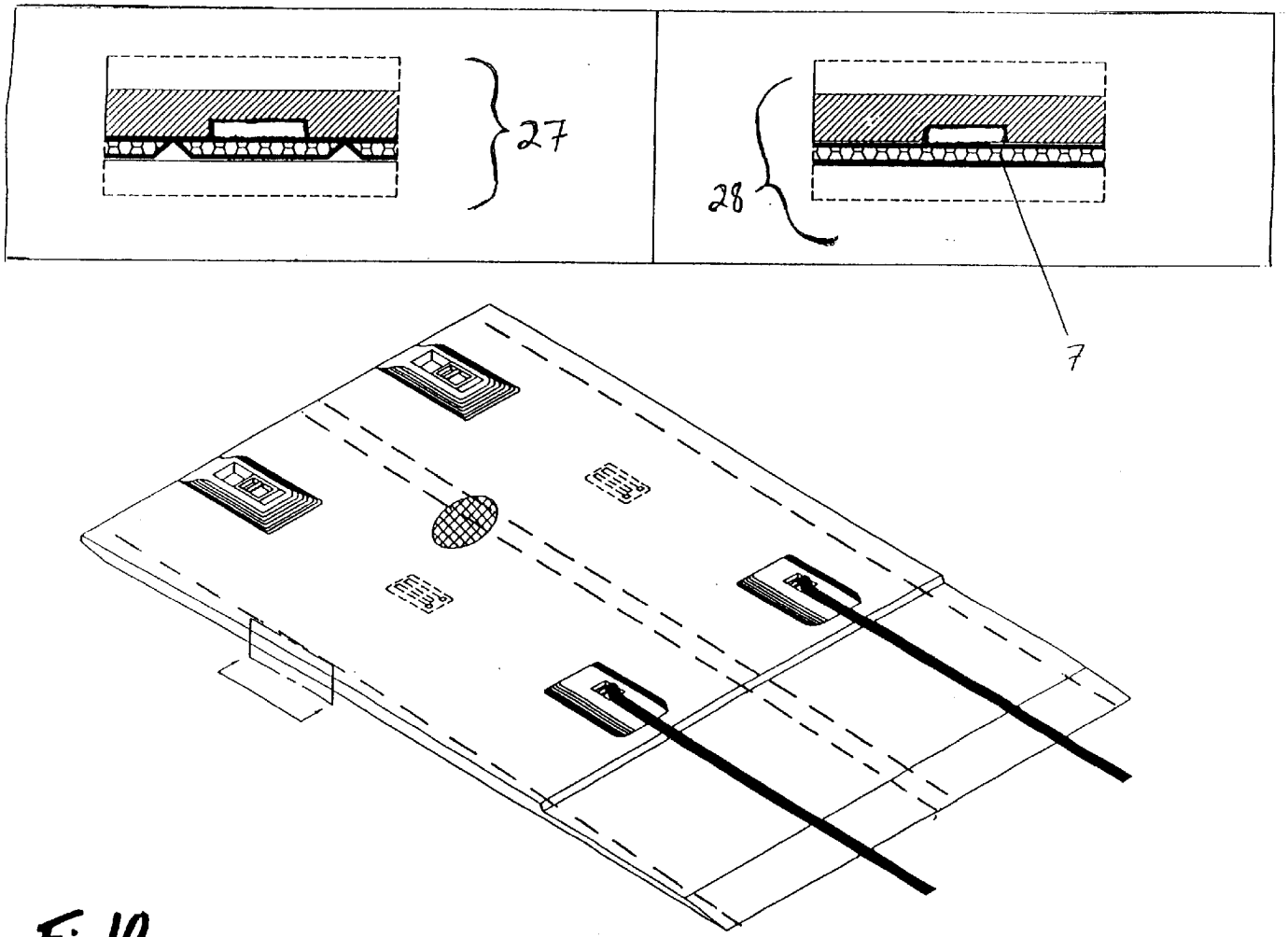
FIG. 10 depicts preferable orientations and constructions of flexible bladder sections used in cuffs on this counterpulsation unit.

FIG. 10 depicts an embodiment of the flexible bladder section 7, wherein bladder sections run along the length of a cuff and are situated contiguous with the bottom of the flexible surface layer 1 in such manner that each actuator unit 3 and tension strap attachment 4 is complimented by a separate portion of flexible bladder section 7. This embodiment is preferable as separate actuators compress differently on the same cuff, while retaining the support afforded by a separate bladder section. This flexible bladder section 7 arrangement therefore provides support for the portion of the cuff that is compressed on individual actuator activation. FIG. 10 demonstrates with broken lines the location of two separate flexible bladders 7 as they are situated in the same cuff, each bladder contiguous with the bottom of the flexible surface layer 1, and situated beneath an actuator unit 3 and respective tension strap attachment 4. The top of FIG. 10 shows cross sectional views of two typical flexible bladder section 7 constructions. The cross sectional view 27 on the left side of FIG. 10 is identical to prior descriptions of the flexible bladder section 7 depicted in FIG. 2, except for the difference in orientation of the bladders, namely that separate bladder sections 7 are situated beneath each actuator unit 3 and respective tension strap attachment 4 on the same cuff. The second cross sectional view 28 depicts a construction wherein the flexible bladder section 7 is continuous throughout (without any subsections across the bladder width) and adapted to receive a fixed volume of fluid, such as water, air, gel, or foam substance. Cross sectional view 28 depicts a continuous construction throughout, meaning without bladder subsections 25 or empty cavities 26 running width-wise, however, a construction as depicted in cross section 28 may still be divided so that on the same cuff flexible bladder section 7 is comprised of separate sections situated beneath each actuator unit 3 and respective tension strap attachment 4.

Contiguous with the bottom of flexible bladder section 7 is preferably a flexible liner layer 6, that accomplishes friction reduction and sealing of opposite ends of the cuff during activation of the cuff. The liner layer 6 is typically of a construction material having a low coefficient for friction such as teflon, plastic, nylon, or aramid. Additionally, one or more pressure sensors 8 are typically imbedded in the actuator cuff. Pressure sensors 8 are imbedded in either the flexible surface layer 1, flexible liner layer 6, or flexible bladder section 7. Preferably, pressure sensors are imbedded touching both the flexible bladder section 7 and flexible surface layer 1. Such sensors are able to detect material strain in the cuff and electronically transmit this information for processing by computer means. The pressure sensors 8 thereby provide electronic feedback data and detect the degree of compression accomplished by the actuator cuffs and individual actuators during operation. This data can be interpreted during treatment for adjustment of cuff and actuator activation.

When a cuff is applied to a patient, it is typically wrapped around the patient's extremity or lower torso and its ends are fastened together and held tautly with tension straps 5. Tension straps 5 are preferably velcro straps, typically a synthetic material such as high strength nylon, having both a layer of tiny hooks and a complementary layer of a clinging pile; so that the two layers of material can be pulled apart or pressed together for easy fastening and unfastening, and for attachment of both ends of the actuator cuff.

The cuffs of the present invention operate by electromechanical means to constrict. This constriction is typically accomplished through use of actuators 3A housed on top of the flexible surface layer 1. Actuators 3A are preferably solenoid devices of either linear or rotary operation. FIG. 1 depicts where actuators units 3 are typically positioned on the present invention. Actuator units 3 are comprised of an actuator 3A, actuator attachment 3B, and the actuator housing 3C, Typically affixed on the top of the flexible surface layer 1 are the actuator units 3, and tension strap attachments 4. The present invention preferably has one or more tension strap attachments 4 more toward one end of the flexible surface layer 1 to which tension straps 5 are connected. FIG. 1, 2, and 3 further depict an opposite end of the flexible surface layer 1 on top of which are one or more actuator units 3. Each of these actuator units 3 is situated across and opposite from a tension strap attachment 4. This arrangement permits for fastening the tension strap 5 between the actuator attachment 3B and the tension strap attachment 4 when the cuff is wrapped around a patient. The actuator attachment 3B is affixed to the actuator 3A that is in turn positioned within the actuator housing 3C. On electromechanical activation, the actuators 3A move away from the cuff end (toward the cuff's center), and within the actuator housing 3C which remains stationary. The tension straps 5 are attached on one end to the actuator attachment 3B that is attached to the actuator 3A, and on opposite end of the tension strap 5 to the tension strap attachments 4. Consequently, this movement of the actuators 3A pulls the tension straps 5 tighter, thereby causing ends of the cuff to constrict toward one another. Preferably, the tension strap attachments 4 and actuator units 3 have tension spread footings 2 to better resist strain during cuff activation. The tension spread footings 2 are preferably stair-stepped, and pyramidal, in shape.

FIG. 1 further depicts a cuff where the flexible surface layer 1 is shaped to afford contour of fit during activation. Contouring allows the ends of a cuff to fit together smoothly when the cuff is affixed to a patient. Also, contouring of the layers serves to make a more comfortable device for patients because contoured cuff ends will not pinch a patient during operation of the cuff. FIGS. 1 and 2 both show contouring typical of an unfastened flexible surface layer 1. For example, the flexible surface layer 1 is stepped down from top to bottom along the entire width of the cuff and at a stepped point 12 just beyond the tension strap attachments 4. This step decreases the thickness of the flexible surface layer I along its entire width making an overlap section 10. At a point closer to the end of the flexible surface layer 1, the thickness is preferably tapered to a point, the tapered end 9. The entire width of the opposite end of the flexible surface layer 1 preferably forms an abrupt taper 11 upward from a point beginning from the bottom of the flexible surface layer 1 and at a point beyond contact with the flexible bladder section 7.

FIG. 3 is an end view of the electromechanical actuator cuff embodied in FIGS. 1 and 2 as the cuff would appear during use. Opposite ends of the cuff are rolled toward one another in circular fashion for affixation around a patient's body and/or extremities. The entire electromagnetic cuff is flexible, but when placed around a human extremity, would appear primarily circular as pictured. Fit contouring of the flexible surface layer 1 is also shown, including the stepped point 12 which defines a beginning of the flexible overlap section 10, and which further narrows to a tapered end 9. This overlap section 10 wraps around in circular fashion to meet the opposite end of the flexible surface layer 1 that preferably culminates in an abrupt taper 11. The diameter 20 of this fastened cuff will vary in the range of 1.0 and 20.0 inches, variable on activation. FIG. 3 further depicts a tension strap 5 as it would appear in fixed position between a tension strap attachment 4 and the actuator attachment 3B.

Figure 4:
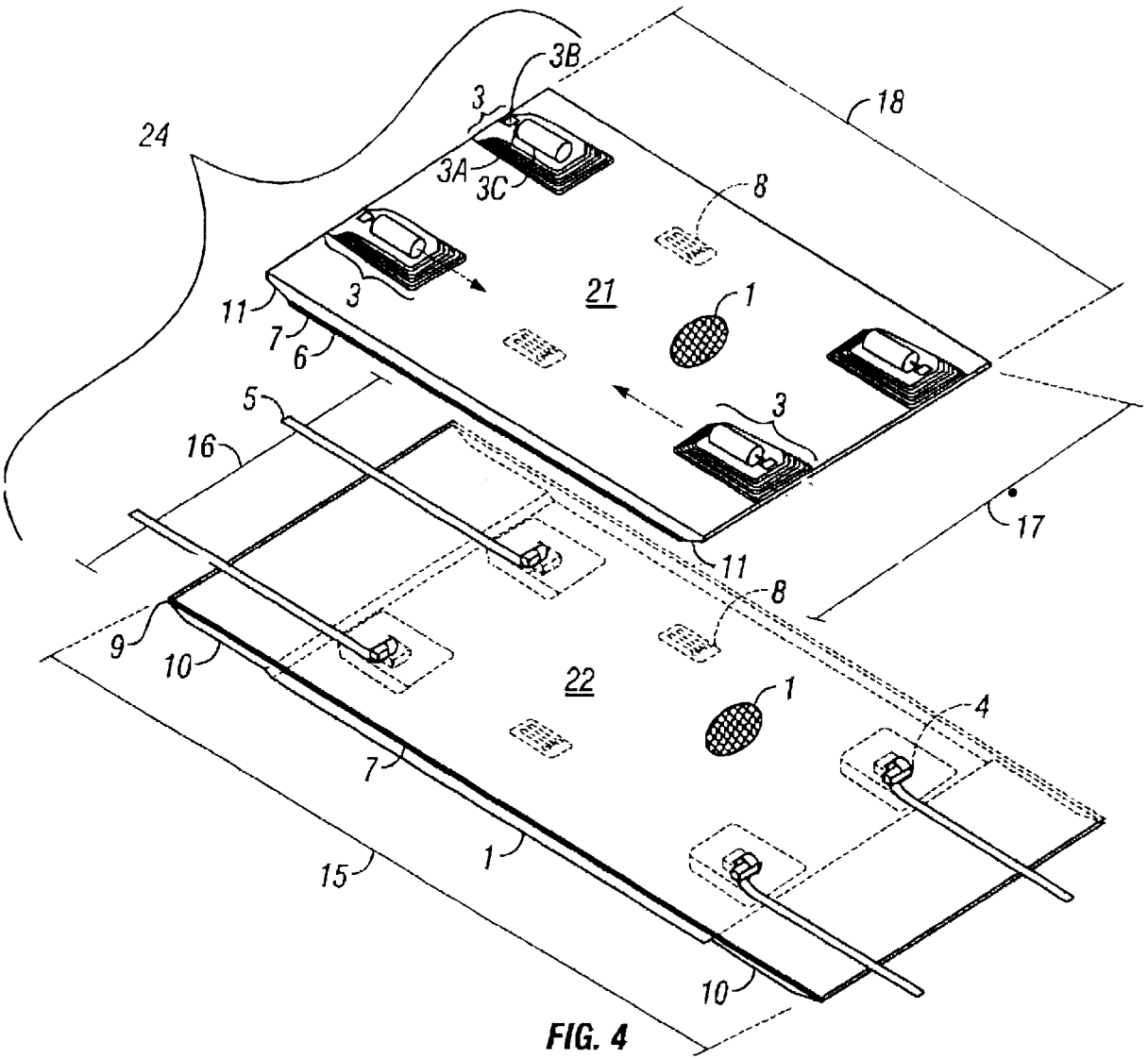
FIG. 4 is an isometric view of an electromechanical actuator cuff comprising an upper and lower section and which is an embodiment of the cuff for use on a patient's lower torso.
Figure 5A:
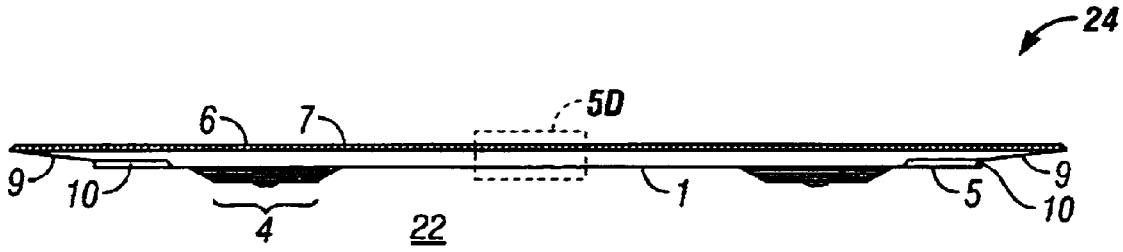
FIG. 5 is an end view of the electromechanical actuator cuff depicted in FIG. 4 and additionally provides sectional views.
Figure 5B:
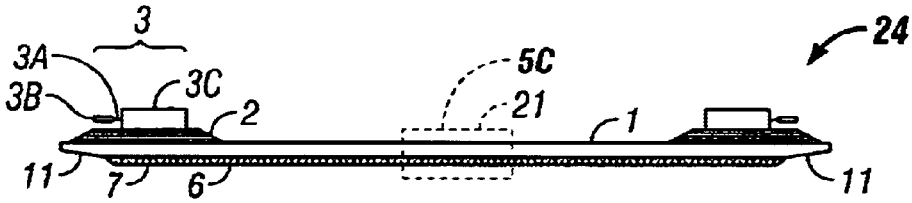
Figure 5C:
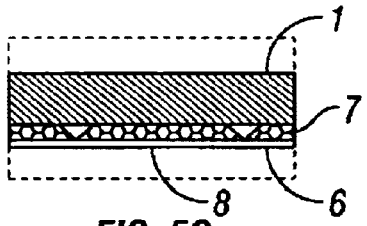
Figure 5D:
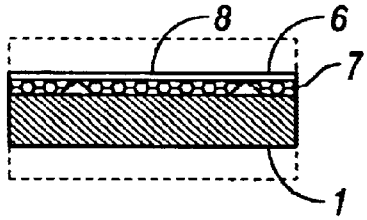
Figure 6:
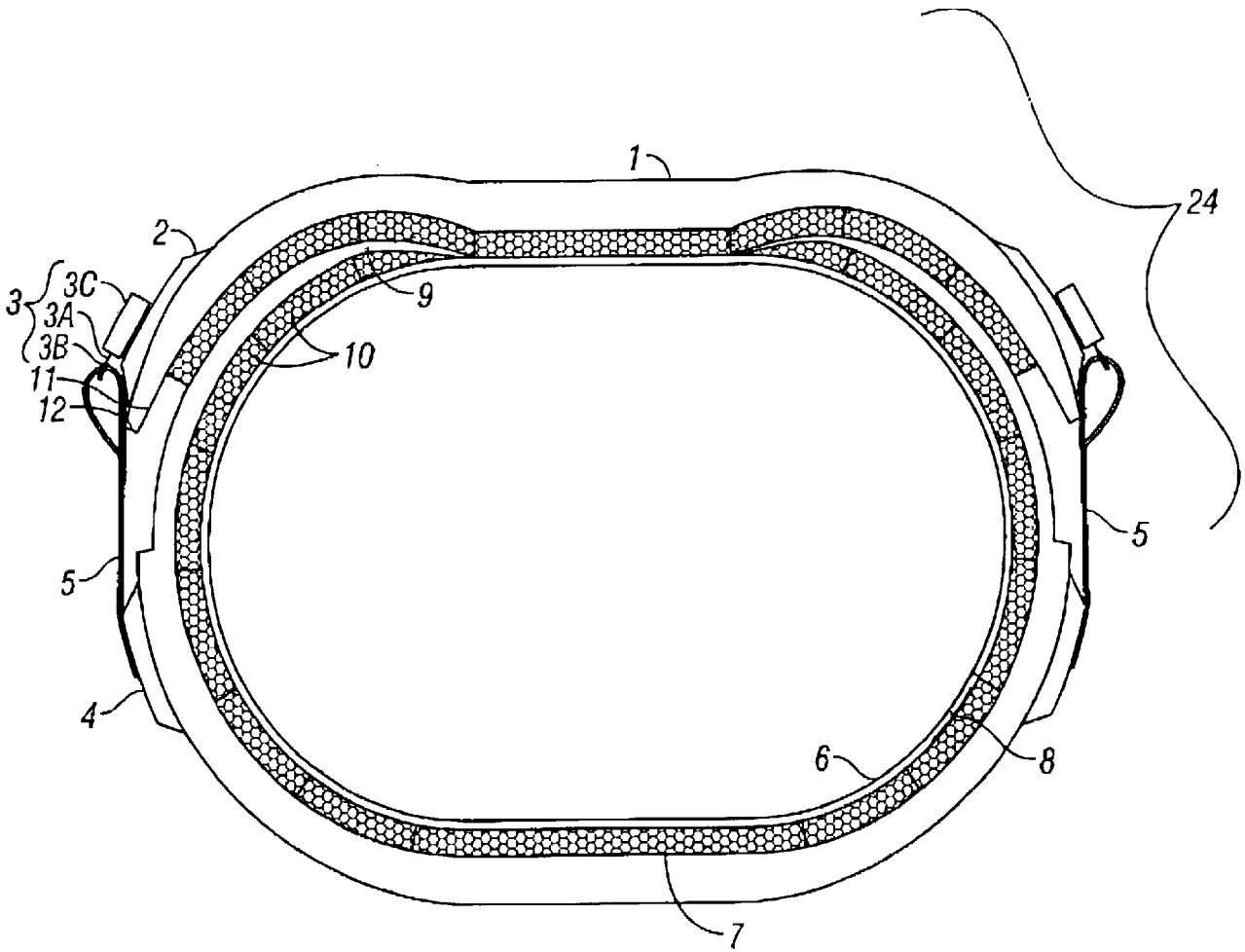
FIG. 6 is an end view of the electromechanical actuator cuff in FIGS. 4 and 5 as the cuff would appear during use.
Figure 6A:
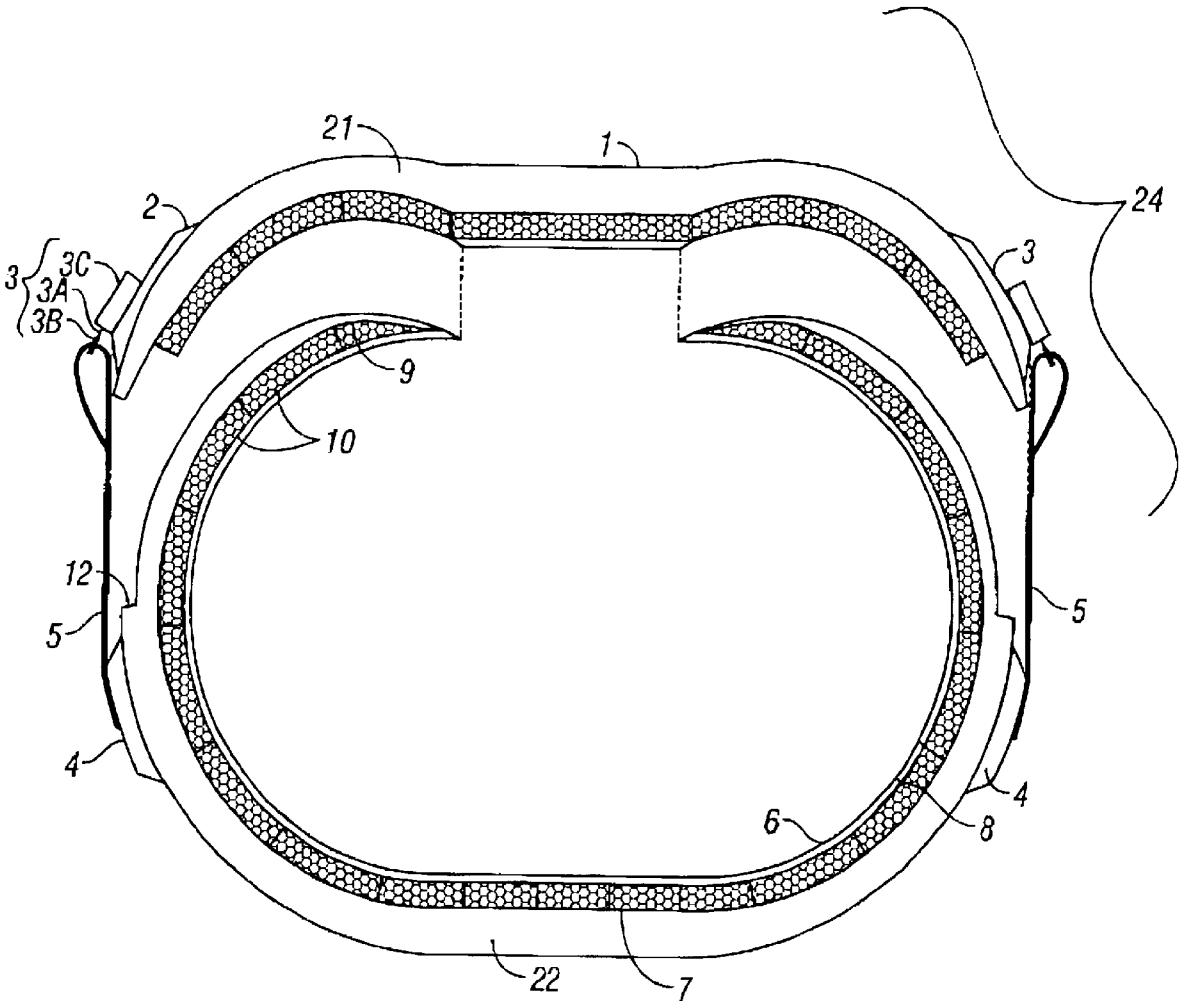
FIG. 6A depicts an exploded view of the embodiment of FIG. 6.

FIG. 4 defines a separate embodiment of the electromechanical actuator cuff that is designed for use with the first embodiment of the cuff, shown in FIGS. 1, 2, and 3 and with multiple units, as depicted in FIG. 7. This double section cuff 24 embodiment, shown in FIG. 4, 5, 6 and 6A is designed for affixation to wider parts of a human body such as the torso, thorax, and buttocks. It is, however, possible that such device could be used on the extremities such as arm and legs as part of counterpulsation treatment. As with the single section cuff 23 shown in FIGS. 1, 2, and 3, the double section cuff 24 compresses on electromechanical activation, and is designed to correlate with physiological data obtained from a patient, however, this embodiment 24 is comprised of two separate sections. Unlike the first single section cuff 23 that has both actuator units 3 and tension strap attachments 4 affixed to the same flexible surface layer 1, this second embodiment 24 has a plurality actuator units 3 fixed on one upper section 21, and tension strap attachments 4 fixed on a separate lower section 22. The two sections of the cuff fit together and constrict as depicted in FIGS. 6 and 6A. On activation, both upper and lower sections of the cuff move toward one another, constricting, and applying pressure to the portion of the patient's body to which the cuff was affixed.

The two section cuff 24 depicted in FIG. 4 is made up of an upper section 21 and a lower section 22 that are adapted to connect to one another. Both upper section 21 and lower section 22 have a flexible surface layer 1 similar to that in the single section cuff 23, however with different contouring. On both the upper 21 and lower 22 section of the actuator cuff, thickness 19, meaning the sum measurement of either one layer or of a preferable cuff construction comprising a flexible surface layer 1, flexible bladder section 7, and flexible liner layer 6, is its at thickest point between 0.1 and 3.0 inches. As with the single section cuff 23, the upper section 21 and lower 22 sections of the actuator cuff have a preferable flexible surface layer 1 that is made of a material for flexibility, appearance, durability, and strength. The flexible surface layer 1 is typically made from kevlar, plastic, nylon, or aramid. The flexible surface layer 1, is preferably made from a resilient construction that will not have significant stretch within the range and duration of the unit's operation. In both the upper 21 and lower 22 sections, contiguous with the bottom of the flexible surface layer 1 is preferably a flexible bladder section 7 that contains a fixed volume of fluid or gel material. The bladder section typically contains fluid such as air, gel, foam substance, or water. The bladder section 7 is flexible so that it bends with the actuator cuff on compression, but does not inflate or deflate pneumatically upon activation of the cuff. As with the single section cuff 23, the bladder section 7 is typically comprised of bladder subsections 25, with empty cavities 26 between each subsection so as to enhance flexibility of the bladder section 7 and cuff as a whole during operation.

In yet another embodiment of the flexible bladder section 7, bladder sections run along the length of each cuff and are situated contiguous with the bottom of the flexible surface layer 1 in such a manner that a pair of actuator units 3 of the upper section 21 and respective pair of tension strap attachments 4 of the lower section 22 are supported by a portion of flexible bladder section 7 running longitudinally on one side of each cuff section. Flexible bladder sections on each side of separate lower 22 and upper 21 sections work together providing support independent of support provided by the flexible bladder section 7 portion situated on an opposite side of the same cuff for separate respective actuator units 3 and tension strap attachments 4.

FIG. 10 shows cross sectional views of two typical flexible bladder section 7 constructions on the single section cuff embodiment 23 that are useful for showing the same embodiment on the double section cuff embodiment 24. The cross sectional view 27 on the left side of FIG. 10 is identical to prior descriptions of the flexible bladder section 7 depicted in FIG. 2, except for the difference in orientation of the bladders. The flexible bladder section 7 is divided into two sections that run longitudinally along the side of each cuff so as to support a pair of actuator units 3 (if on the upper section 21) or a pair of tension strap attachments 4 (if on the lower section 22). The second cross sectional view 28 depicts a construction wherein the flexible bladder section 7 is continuous throughout (without any subsections across the bladder width) and adapted to receive a fixed volume of fluid, such as water, air, gel, beads (typically plastic), or foam substance. Cross sectional view 28 depicts a continuous construction throughout, meaning without bladder subsections 25 or empty cavities 26 running width-wise, however, a construction as depicted in cross section 28 may still be divided so that each cuff section (both upper and lower) preferably have a flexible bladder section 7 comprised of separate sections situated beneath each actuator unit 3 and respective tension strap attachment 4.

As with the single section cuff 23, and in both upper 21 and lower 22 sections of the cuff, contiguous with the bottom of the flexible bladder section 7 is preferably a flexible liner layer 6 that accomplishes friction reduction and sealing ends of the cuff during activation of the cuff. This liner layer 6 is typically made of kevlar or smooth plastic. The liner layer 6 is typically of a construction material having a low coefficient for friction. Preferably, in both upper section 21 and lower section 22 of the actuator, one or more pressure sensors 8 are imbedded in the actuator cuff. Sensors 8 are able to detect material strain and transmit this information for processing. The pressure sensors 8 thereby detect the degree of compression or relaxation accomplished by the actuator cuffs during operation. Pressure sensors 8 are imbedded in either the flexible surface layer 1, flexible liner layer 6, or flexible bladder section 7. Preferably, pressure sensors 8 are imbedded next to the liner layer 6. The electromechanical mechanism in the double section cuff embodiment 24 is essentially the same as that with the single section cuff embodiment 23, however, with a difference being that actuator units 3 and tension strap attachments 4 are not affixed to the same surface on the second cuff embodiment 24.

In this two section cuff embodiment 24, on the top of the flexible surface layer 1 of the upper section 21 are a plurality of actuator units 3, and contained actuator attachments 3B. All of the tension strap attachments 4, however, are on the lower section 22 of the cuff and attached to the flexible surface layer 1 on the side opposite the flexible bladder section 7. As depicted in FIGS. 4 and 5, the lower section 22 has a plurality of tension strap attachments 4 from which are attached a plurality of tension straps. Tension straps are adapted at one end to be received by the actuator units 3, and contained actuator attachments 3B on the upper section 21 of the actuator cuff. Opposite ends of the tension straps are adapted to be received by tension strap attachments 4 fixed on the cuff's lower section 22. Actuator units 3 and tension strap attachments 4 have tension spread footings 2. On operation of the two section cuff 24, the actuators 3A move toward the center of the upper section 21 and pull tension straps which are connected to tension strap attachments 4 on the lower section 22 of the two section cuff 24. As a result, the upper section 21 and lower section 22 constrict towards one another, applying pressure to a patient at the point where the cuff is affixed on the patient's body.

Both the lower section 22 and upper sections 21 of the cuff have similar construction, usually a flexible surface layer 1, flexible bladder section 7, pressure sensor 8, and flexible liner layer 6. The upper section 21 and lower section 22 are different in terms of their geometric dimensions (length and width) and with regard to fit contours of their respective flexible surface layers 1. FIG. 4 shows the lower section 22 of the cuff is typically defined on opposite ends of its length by a stepped point 12 from which point the thickness of its flexible surface layer 1 is decreased (as in the first cuff embodiment); forming an overlap section 10; and where the overlap section 10 continues and preferably culminates with a tapered end 9. Opposite ends of the lower section 22 mirror one another from a hypothetical midline across the lower section's width. The lower section width 16 in the range of 2.0 and 20.0 inches and the longest lower section length 15 in the range of 10.0 and 40.0 inches. The upper section 21 in FIG. 4 is different from the lower section 22 in terms of dimension and fit contouring of the flexible surface layer 1. The upper section width 17 is in the range of 2.0 and 20.0 inches and the upper section length 18 is in the range of 5.0 and 30.0 inches. The upper section 21 has preferably an abrupt taper 11 that extends along the entire width of opposite ends. Such abrupt tapers 11 begin typically on the flexible surface layer 1 at each end at a point beyond contact with the flexible bladder section 7. The abrupt taper 11 depicted in FIGS. 4 and 5 on the upper section 21 is identical to the abrupt taper depicted in FIG. 1.

FIG. 5 is an end view of the electromechanical actuator cuff depicted in FIG. 4 and additionally provides sectional views. The numbering is the same as shown in FIG. 4.

FIG. 6 provides an end view of the electromechanical actuator cuff in FIGS. 4 and 5 as the cuff would appear during use when the upper 21 and lower 22 sections are fit together around a patient. The tension straps are shown as they appear when fixed between the actuator attachment 3B and tension strap attachment 4. FIG. 6 additionally depicts how contouring of the flexible surface layers 1 of both upper 21 and lower 22 sections accomplishes a smooth fit between parts. The flexible surface layer 1 of the lower section 22 forms an overlap section 10 from a stepped point 12 and culminates with a tapered end 9. On electrical activation, the actuators 3A and actuator attachments 3B move away from the upper section 21 ends and toward the center. The tension straps tighten because they are connected at one end to the actuator attachments 3B, and at opposite end to stationary tension strap attachments 4. As the tension straps tighten, the upper 21 and lower 22 sections of the cuff constrict together for treatment purposes. A pressure sensor 8 as shown in FIG. 6 detects the amount of material strain in the cuff and electronically transmits data regarding the cuffs action. Both upper 21 and lower 22 sections contain pressure sensors 8.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

I claim:

1. A method of treating a medical condition using counterpulsation with electromechanically activated cuffs comprising the steps of:

a. detecting physiological data from a patient through use of medical devices;

b. transmitting said physiological data electronically from said devices to a processor;

c. electronically processing said physiological data to determine when the patient's heart is in a diastolic or a systolic phase;

d. electronically activating a plurality of electromechanical cuffs; each said electromechanical cuff having at least one constriction set, said constriction set having an actuator unit and a tension attachment, each said actuator unit being controllably operable to a plurality of positions, said plurality of positions being within a range of positions, said range of positions ranging from a relaxed position to a constricted position, a distance between said actuator unit and said tension attachment, said distance with said actuator unit in said relaxed position being greater than said distance with said actuator unit in said constricted position, and said distance directly related to each position of said actuator unit in said range of positions, and said actuator unit controllably operable from said relaxed position to any of said positions within said range of positions on activation;

e. electronically timing said activation of each said electromechanical cuff to correlate with the phases of the patient's heart; and f. modifying said timing of said activation of said plurality of electromechanical cuffs according to changes in said physiological data affected by said activation.

2. The method of claim 1 further comprising activating a series of said electromechanical cuffs, which are affixed to a patient's body and extremities, from a distal to a proximal direction on the patient.

3. The method of claim 1 further comprising activating a series of said electromechanical cuffs, which are affixed to a patient's body and extremities, from a proximal to a distal direction on the patient.

4. The method of claim 1 further comprising sequentially activating a series of said electromechanical actuator units, which are situated on cuffs affixed to a patient's body.

5. The method of claim 1 further comprising sequentially activating a series of electromechanical actuator units, said electromechanical actuator units being situated on cuffs affixed to a patient's body, and wherein a typical delay between initiation of activation of any two sequential said actuator units is in the range of 12 to 36 milliseconds.

6. The method of claim 1 further comprising activating each cuff in a series of cuffs, said cuffs being compressed from a distal to proximal direction on the patient, so that there are between 35 and 50 milliseconds between initiation of activation of each cuff in the series.

7. The method of claim 1 further comprising activating each of the electromechanical cuffs on the patient separately to compress with a strength in the range 0.1 an 7.0 pounds of pressure per square inch.

8. The method of claim 1 further comprising activating each of the electromechanical cuffs such that a graded pressure is applied to the patient.

9. The method of claim 1 further comprising activating each of the electromechanical cuffs so that a graded sequential pressure is applied to a patient.

10. The method of claim 1 further comprising activating each of the electromechanical cuffs independently so that one actuator unit or cuff in a series compresses more quickly than will a separate unit or cuff.

11. The method of claim 1 further comprising relaxing a series of said electromechanical cuffs, which are affixed to a patient's body and extremities, from a distal to a proximal direction on the patient.

12. The method of claim 1 further comprising relaxing the series of said electromechanical cuffs, which are affixed to a patient's body and extremities, from a proximal to a distal direction on the patient.

13. The method of claim 1 further comprising relaxing the series of said electromechanical cuffs, which are affixed to a patient's body and extremities simultaneously.

14. The method of claim 1 further comprising setting activation of each cuff in a series of said cuffs, which are compressed from a proximal to distal direction on the patient, so that there is a range of 35 and 50 milliseconds between activation of each cuff in the series.

15. A unit for use in counterpulsation treatment of patients comprising:

a. a means for obtaining and transmitting physiological data from a patient.

b. a means for electronically receiving said physiological data;

c. a means for processing said physiological data and to correlate and activate a plurality of actuator cuffs according to said physiological data;

d. said plurality of actuator cuffs to be received on a patient, each said actuator cuff having at least one constriction set, said constriction set having an actuator unit and a tension attachment, each said actuator unit being controllably operable to a plurality of positions, said plurality of positions being within a range of positions, said range of positions ranging from a relaxed position to a constricted position, a distance between said actuator unit and said tension attachment, said distance with said actuator unit in said relaxed position being greater than said distance with said actuator unit in said constricted position, and said distance directly related to each position of said actuator unit in said range of positions;

e. said actuator unit controllably operable from said relaxed position to any of said positions within said range of positions on activation; and, f. a means for modifying said activation of said plurality of actuator cuffs according to changes in said physiological data affected by said activation.

16. The counterpulsation device as described in claim 15 wherein said actuator cuffs are rectangular or trapezoidal in shape to accommodate increasing or decreasing thickness of patient extremities.

17. The counterpulsation device as described in claim 15 wherein each of said plurality of actuator cuffs further comprises:

a. a flexible surface layer having a top and a bottom;

b. a flexible bladder section contiguous with the bottom side of the surface layer;

c. a flexible liner layer contiguous with the bottom layer of the flexible bladder section;

d. a plurality of tension strap attachments fixed at an end of the top side of the flexible surface layer;

e. a plurality of actuator units on an opposite end of the top side of the flexible surface layer;

f. an actuator attachment located within each of said actuator units; and, g. a plurality of cuff connectors which each attach at one end to the tension strap attachments, each of said cuff connectors having an opposite end being attached to said actuator attachments.

18. The counterpulsation device as in claim 17, wherein the flexible liner layer is chosen from the group consisting essentially of teflon, plastic, nylon, or aramid.

19. The counterpulsation device as in claim 17, wherein the flexible surface layer is chosen from the group consisting essentially of kevlar, plastic, nylon, or aramid.

20. The counterpulsation device as in claim 17, wherein said cuff connectors are of synthetic material having both a layer of tiny hooks and a complementary layer of a clinging pile; said two layers of material are capable of being pulled apart or pressed together for easy fastening and unfastening, and for attachment of both ends of the actuator cuff.

21. The counterpulsation device as in claim 17, wherein each said actuator unit and each said tension strap attachment has a tension spread footing.

22. A counterpulsation device as in claim 17, wherein said flexible surface layer is decreased in thickness at a stepped point along an entire width of one end forming an overlap section which continues until the surface layer becomes a tapered point; and wherein the entire width of an opposite end of said flexible surface layer defines an abrupt taper upward from a point beyond contact with the flexible bladder section.

23. The counterpulsation device as in claim 17, wherein a sum thickness of the flexible surface layer, flexible bladder section, and flexible liner layer is between 0.1 and 3.0 inches at the thickest point.

24. The counterpulsation device as in claim 17, wherein a cuff width is in the range of 1.0 and 20.0 inches.

25. The counterpulsation device as in claim 17, wherein length of the cuff is in the range of 4.0 and 40.0 inches.

26. The counterpulsation device as in claim 17, wherein a diameter of an affixed actuator cuff as measured from said flexible liner layer is in the range of 1.0 and 12.0 inches.

27. The counterpulsation device as in claim 17 wherein the flexible bladder section further comprises a plurality of bladder subsections with a plurality empty cavities between each said subsection.

28. The counterpulsation device as described in claim 15 wherein each of said actuator cuffs further comprises:

a. a separate upper section and separate lower section adapted for connection with one another;

b. said upper and lower sections each having a flexible bladder section contiguous with a flexible surface layer on a first side of said flexible bladder section and contiguous with a flexible liner layer on a second side of said flexible bladder section;

c. a plurality of actuator units fixed at the ends of said upper section on a surface of the flexible surface layer opposite said flexible bladder;

d. an actuator attachment situated within each of said actuator units;

e. a plurality of tension strap attachments fixed at opposite ends of the lower section and on a surface of the flexible surface layer opposite the flexible bladder layer; and, f. a plurality of cuff connectors which attach at one strap end to the tension strap attachments, and which have an opposite end adapted for receipt by said actuator attachments.

29. The counterpulsation device as described in claim 28 wherein said actuator units and wherein said tension strap attachments have tension spread footings.

30. The counterpulsation device as in claim 28, wherein said flexible surface layer of the lower section decreases in thickness at a stepped point, along the entire width of both ends of said lower section to form an overlap section;

the overlap section is followed by a tapered end where the thickness of the flexible surface layer decreases to a point.

31. The counterpulsation device as in claim 28, wherein the flexible surface layer of the upper section is tapered at opposite ends to a narrow thickness along the entire width of said ends defining an abrupt taper;

said abrupt taper beginning at each end at a point beyond contact with the flexible bladder section.

32. A counterpulsation device as in claim 28, wherein the flexible liner layer is chosen from the group consisting essentially of teflon, plastic, nylon, or aramid.

33. The counterpulsation device as in claim 28, wherein the flexible surface layer is chosen from the group consisting essentially of kevlar, plastic, nylon, or aramid.

34. The counterpulsation device as in claim 28, wherein said cuff connectors are synthetic material having both a layer of tiny hooks and a complementary layer of a clinging pile;

said two layers of material can be pulled apart or pressed together for easy fastening and unfastening, and for looping attachment of the actuator cuff.

35. A counterpulsation device as in claim 28, wherein a thickness of the upper and lower sections are each, including on each, the flexible surface layer, flexible bladder section, and flexible liner layer, in the range of 0.1 and 3.0 inches at a thickest point.

36. A counterpulsation device as in claim 28, wherein a longest width of the upper section is between 2.0 and 20.0 inches and wherein a longest length of the upper section is in the range of 5.0 and 30.0 inches.

37. A counterpulsation device as in claim 28, wherein a longest width of the lower section is between 2.0 and 20.0 inches and wherein a longest length of the lower section is in the range of 10.0 and 40.0 inches.

* * * * *